US007762418B1

(12) United States Patent
Natale

(10) Patent No.: US 7,762,418 B1
(45) Date of Patent: Jul. 27, 2010

(54) GARBAGE CAN WITH WEIGHTED BASE

(76) Inventor: Joseph L. Natale, 4531 Parkview Dr., Apt R-6, Schnecksville, PA (US) 18078

( * ) Notice: Subject to any disclaimer, the term of this patent is extended or adjusted under 35 U.S.C. 154(b) by 337 days.

(21) Appl. No.: 12/034,152

(22) Filed: Feb. 20, 2008

(51) Int. Cl.
*B65D 21/02* (2006.01)
*B65D 90/12* (2006.01)

(52) U.S. Cl. ..... 220/23.87; 220/630; 220/908

(58) Field of Classification Search ..... 220/23.87, 220/625, 630, 737, 739, 906; 280/47.17, 280/47.24, 47.26, 47.34; 62/457.1, 457.7
See application file for complete search history.

(56) References Cited

U.S. PATENT DOCUMENTS 2,650,786 A * 9/1953 Platt ..... 410/51
4,313,612 A * 2/1982 Rubens ..... 280/79.5
5,458,350 A * 10/1995 Johnson et al. ..... 280/47.26
5,806,867 A * 9/1998 Hampton ..... 280/47.34
5,816,586 A * 10/1998 Richmond ..... 280/47.34
5,897,018 A 4/1999 Pruitt
6,488,293 B1 * 12/2002 Mitchell et al. ..... 280/47.34
6,644,493 B1 11/2003 Walton et al.
7,364,049 B2 * 4/2008 Panek, Jr. ..... 220/345.1
7,427,076 B2 * 9/2008 Gwin ..... 280/79.2

* cited by examiner

*Primary Examiner*—Anthony Stashick
*Assistant Examiner*—Harry A Grosso

(57) ABSTRACT

A garbage can unit with weighted base comprises a garbage can, a housing, a wheel assembly, and a T-shaped handle attached to the housing. The can is made cylindrical and provided with a flange at its upper peripheral edge and a pair of handles integrally formed on diametrically opposite sides of the can. The housing is made in the form of a parallelepiped, with a bulged bottom portion, a cylindrical recess being made in the housing to receive the can. The bulged bottom portion of the housing is made hollow and provided with a closeable inlet having a plug and located at a front side of the bulged portion to allow filling an inner space of the bulged bottom portion with filler. The wheel assembly includes a pair of wheels on a common axle attached to a rear side of the bulged portion.

9 Claims, 6 Drawing Sheets

GARBAGE CAN WITH WEIGHTED BASE

FIELD OF THE INVENTION

The present disclosure relates to garbage cans and more particularly to a new garbage can with a weighted base to prevent an empty can from being blown around during windy conditions.

BACKGROUND OF THE INVENTION

Known in the art is a garbage can described in U.S. Pat. No. 5,897,018 issued on 27 Apr. 1999 to Larry Pruitt. The garbage can includes a weighted base having a recess formed in the base. Also included is a garbage can having a bottom adapted to be releasably situated within the recess of the base. Next provided is a plurality of locking tabs for coupling the can within the base.

Also known in the art is a weighted garbage can with legs disclosed in U.S. Pat. No. 6,644,493 issued 11 Nov. 2003 to Sandra T. Walton et al. The weighted garbage can with legs has a receptacle with a rounded weighted base such that the empty garbage can will tend to remain upright and will upright itself if tipped. The weighted garbage can with legs also has retractable legs that function in conjunction with a spring suspended inner platform to retract when the garbage can is empty and extend as the receptacle is filled. The legs extend as the receptacle is filled to stabilize the can as the self-uprighting tendency is overcome when the filled receptacle becomes top-heavy.

A need is still made itself felt for a convenient garbage can with a weighted base.

SUMMARY OF THE INVENTION

According to the present disclosure, a garbage can housing with weighted base comprises a body, a wheel assembly, and a T-shaped handle. The housing body is shaped in a parallelepiped with a bulged bottom portion, and a cylindrical recess is made in the housing to receive the can. The bulged bottom portion of the housing is made hollow and has no fluid communication with the recess. It is provided with a closeable inlet to thereby allow filling an inner space of the bulged bottom portion with filler. The wheel assembly and the T-shaped handle are attached to the housing.

According to another embodiment of the present disclosure, a garbage can unit with weighted base comprises a garbage can proper, a housing, a wheel assembly, and a T-shaped handle. The garbage can is made having a substantially cylindrical body and is provided with a flange at an upper peripheral edge of the body. A pair of handles can be integrally formed on diametrically opposite sides of the can body. The housing is shaped in a parallelepiped with a bulged bottom portion, and a cylindrical recess is made in the housing to receive the can. The bulged bottom portion of the housing is made hollow and has no fluid communication with the recess. It is provided with a closeable inlet to thereby allow filling an inner space of the bulged bottom portion with filler. The wheel assembly and the T-shaped handle are attached to the housing.

The pair of handles can be located on diametrically opposite sides of the flange of the can body.

The closeable inlet can be provided with a plug and located at a front side of the bulged bottom portion of the housing.

The wheel assembly can include a pair of wheels on a common axle attached by means of two axle holders to a rear side of the bulged bottom portion of the housing.

The above-identified features are believed to fulfill the need for a convenient, simple, reliable and easy in use garbage can unit.

BRIEF DESCRIPTION OF THE DRAWINGS

Other objects, features and advantages of the disclosure will become apparent to one skilled in the art by reading the following specification and subjoined claims and by referencing the following drawings, in which:

DETAILED DESCRIPTION OF THE PREFERRED EMBODIMENT

Figure 1:
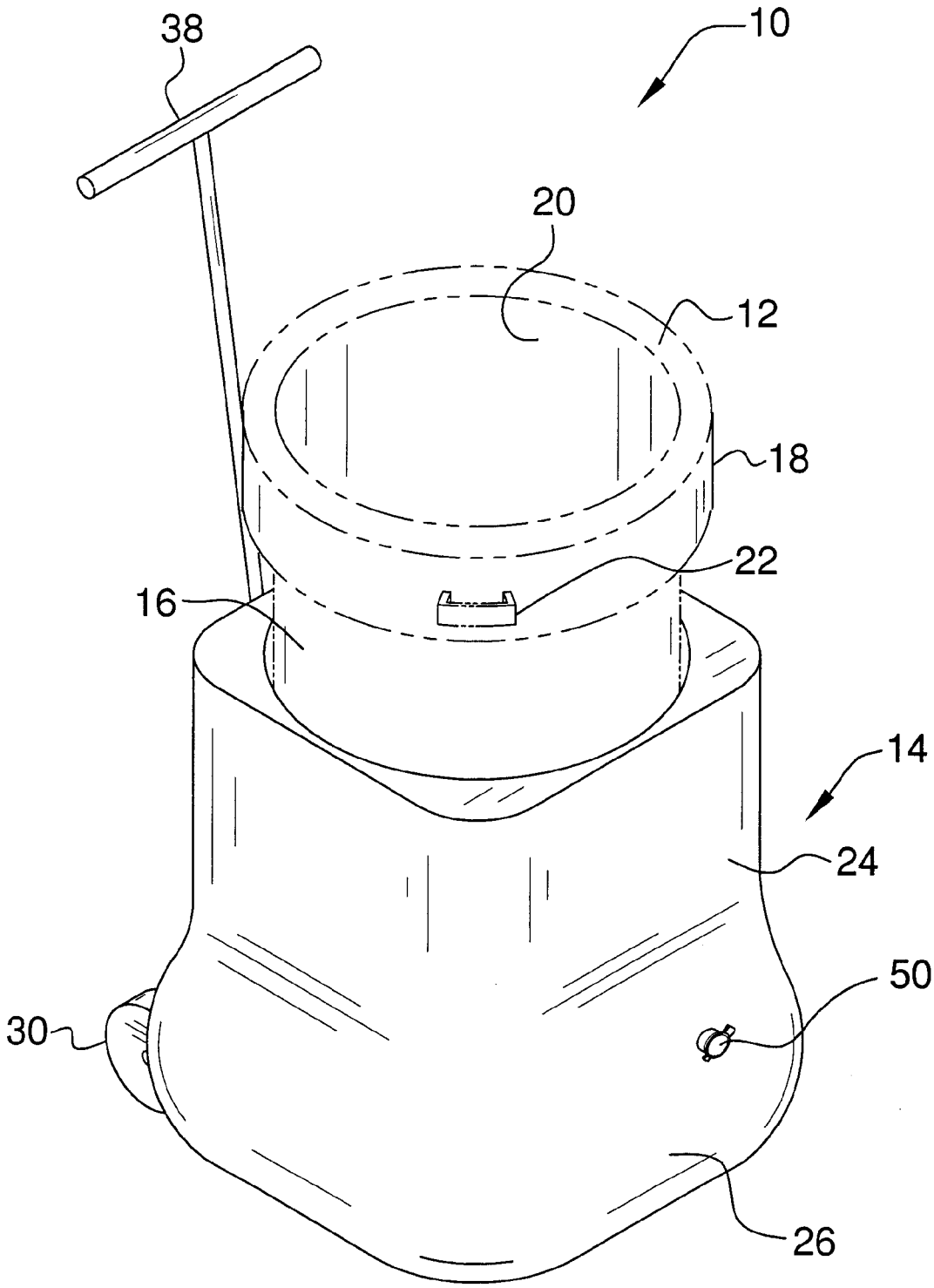
FIG. 1 shows a perspective view of a garbage can unit in accordance with the present disclosure where the front side of the housing is visible.
Figure 2:
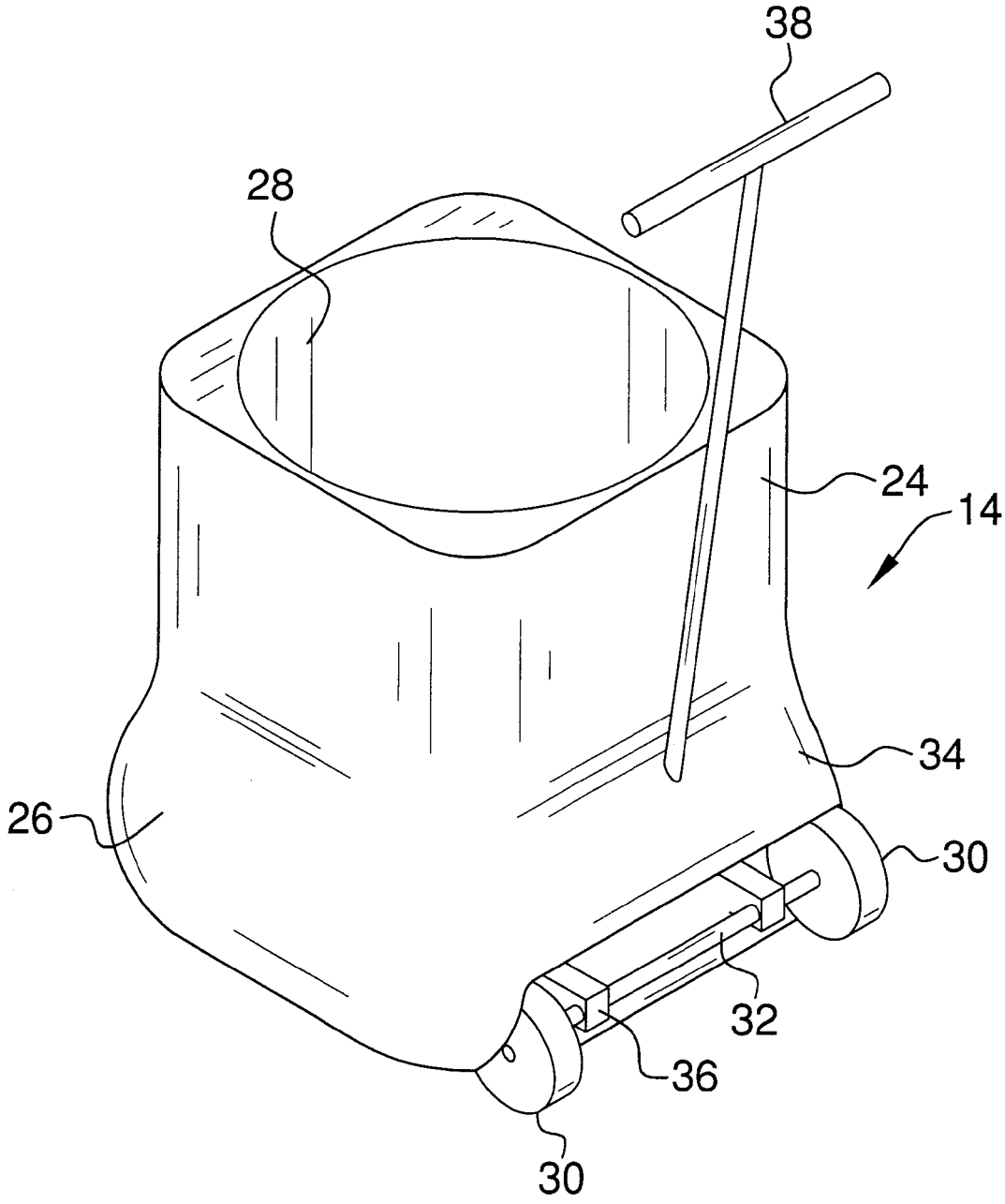
FIG. 2 shows a perspective view of the garbage can housing in accordance with the present disclosure where the rear side of the housing is visible.
Figure 3:
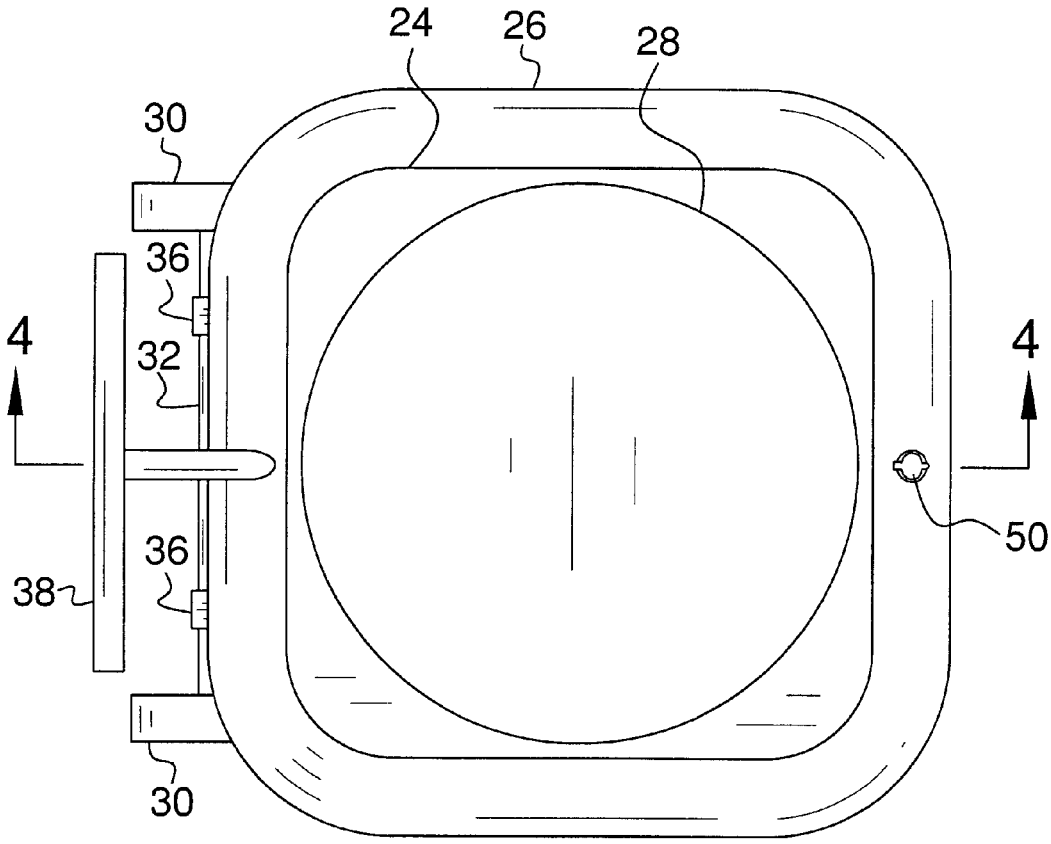
FIG. 3 is a top view of the garbage can housing in accordance with the present disclosure.

Before starting a detailed description of the disclosure, mention of the following is in order. When appropriate, like reference numerals and characters may be used to designate identical, corresponding, or similar components in different figure drawings.

Referring now to FIGS. 1-7, a garbage can unit 10 comprises a can 12 and a housing 14. The garbage can 12 has a substantially cylindrical body 16 and is provided with a flange 18 around its upper peripheral edge 20. It is understood that the can 12 can be provided with a lid (not shown). A pair of handles 22 is attached diametrically to the flange 20.

The housing 14, which can measure about two feet square and high, is preferably made from durable plastic and includes a housing body 24. As a whole, the housing body is shaped in a parallelepiped with rounded corners. Its bottom portion 26, however, is made bulged. A generally cylindrical recess 28 is made in the center of the body 26 to receive the can 12.

Figure 4:
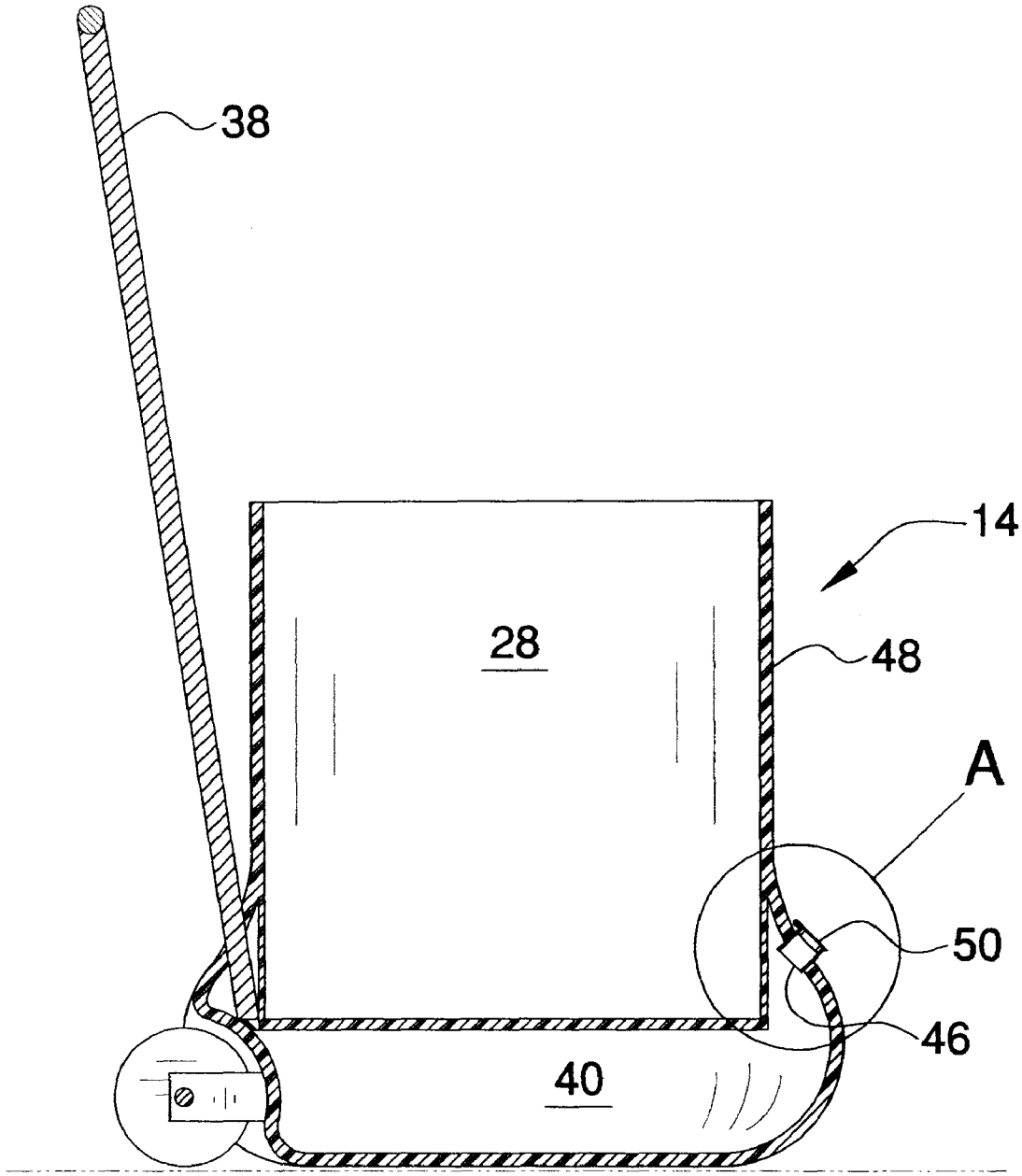
FIG. 4 is a cross-section of the garbage can housing in accordance with the present disclosure, the cross-section being made along line 4-4 of FIG. 3.
Figure 5:
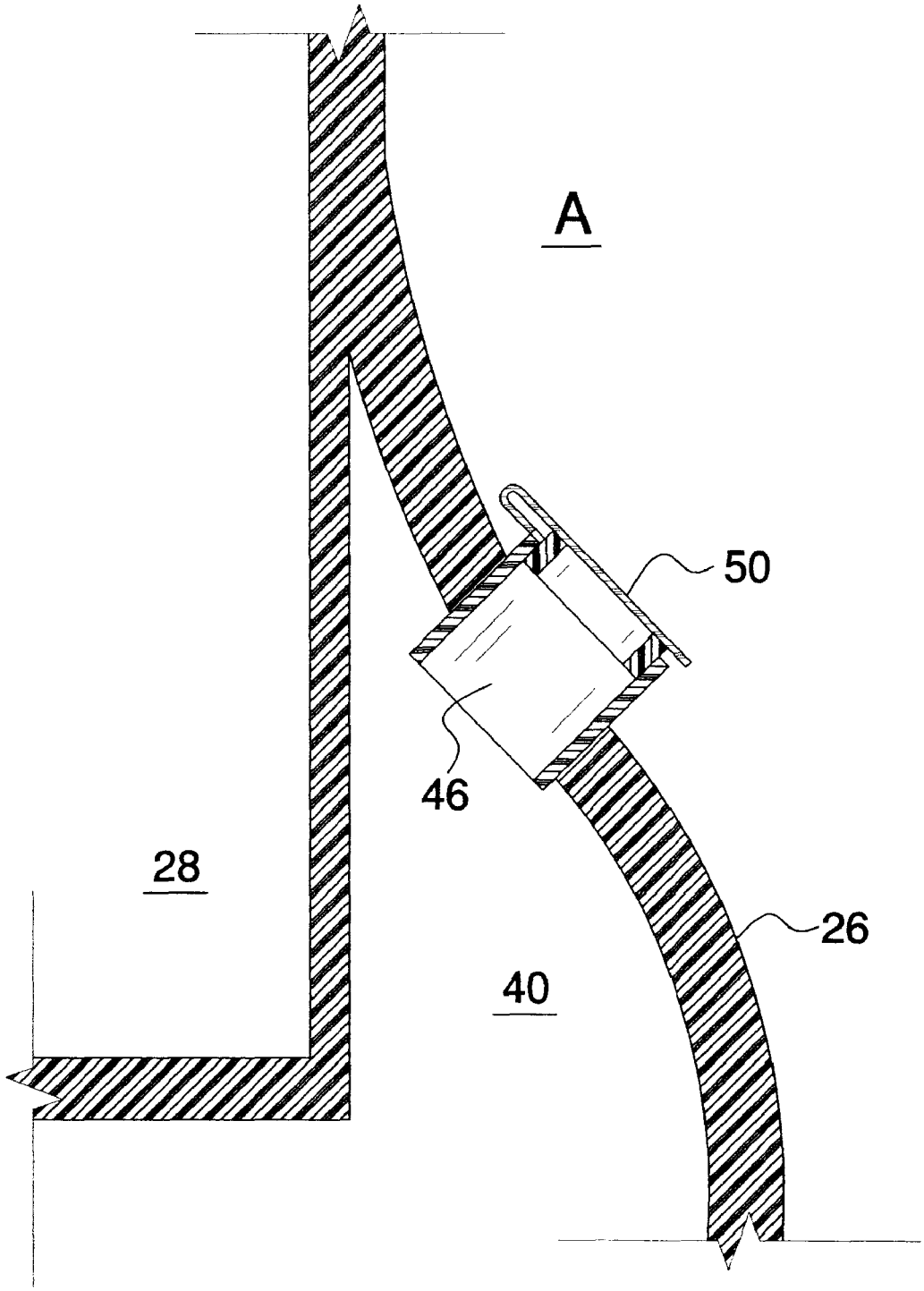
FIG. 5 is an enlarged view of an area A shown in FIG. 4.

A pair of wheels 30 is mounted on a common axle 32, which is attached to a rear side 34 of the housing body 26 by means of axle holders 36. A T-shape handle 38 is attached to the rear side 34, as can be seen in FIG. 4. The wheels 30 used in combination with the T-shape handle 38 would enable the container and the whole unit to be conveniently rolled from one location to another.

Figure 6:
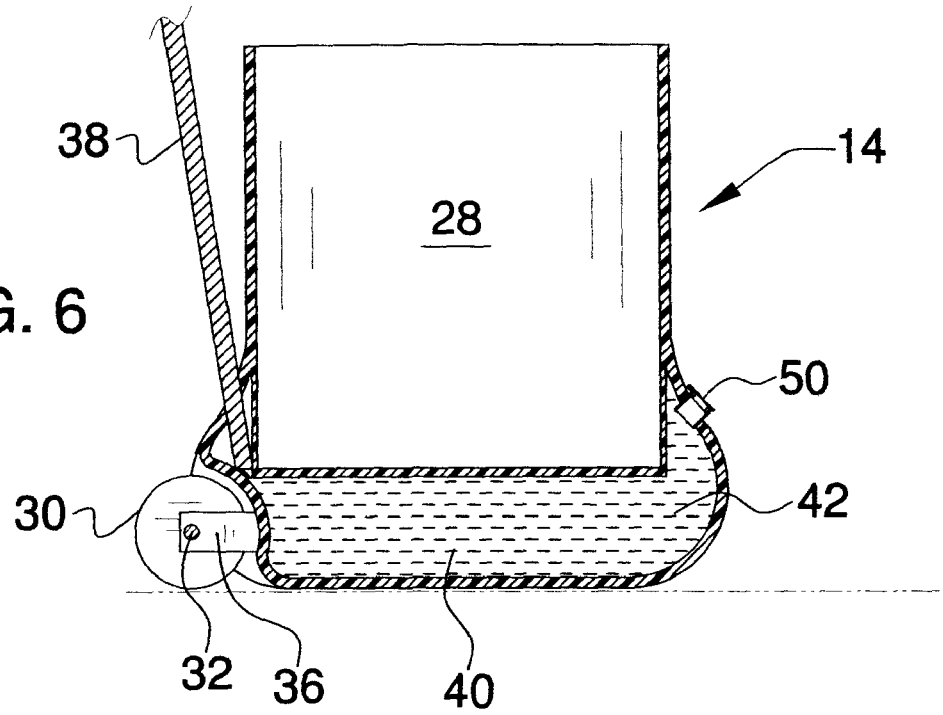
FIG. 6 is a cross-section of the garbage can housing in accordance with the present disclosure, the cross-section being made along line 4-4 of FIG. 3, with a bottom bulged portion of the housing filled with water.
Figure 7:
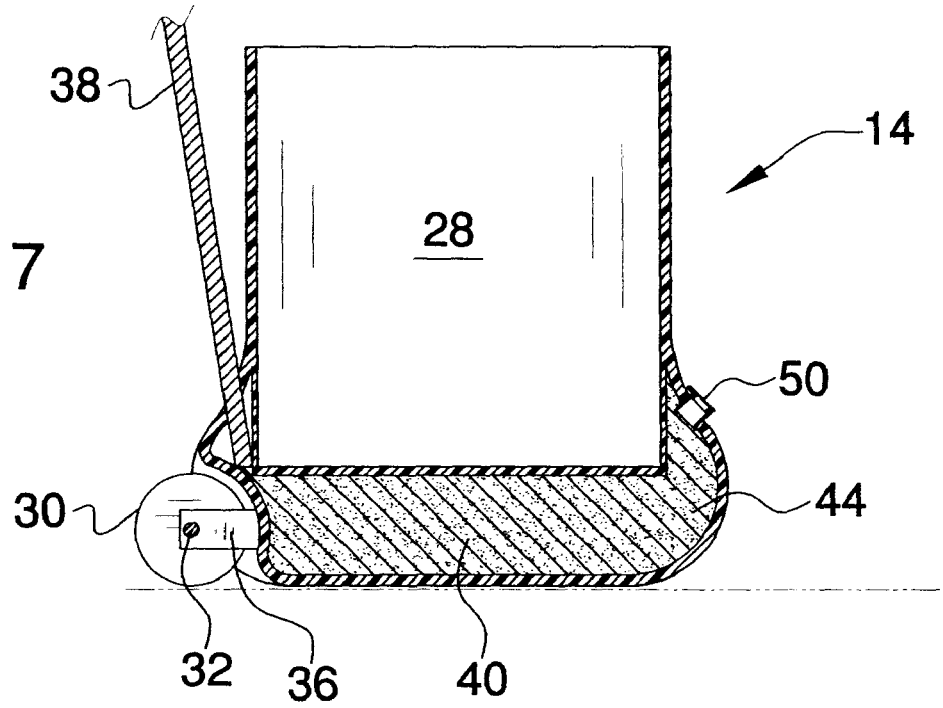
FIG. 7 is a cross-section of the garbage can housing in accordance with the present disclosure, the cross-section being made along line 4-4 of FIG. 3, with the bottom bulged portion of the housing filled with sand.

The bottom bulged portion 26 of the housing 14 is made hollow, with an inner space 40. The inner space and the recess 28 are in no fluid communication with each other. The space 40 is intended to be filled with filler. In FIG. 6, the space 40 is shown filled with water 42, in FIG. 7—with sand 44. An inlet 46 is provided at the top of the bulged portion 26 on the front side 48 of the housing. The inlet 46 can include a plug 50 adapted to be removed, as FIG. 5 clearly illustrates, to allow the hollow interior (space 40) of the housing to be filled. After the space has been filled, the plug 50 would be resealed. This plug could also be pulled to enable the weighting substance to be emptied from the housing. The housing has to be tipped and eventually flipped over to allow the contents to be poured from this unit. Once weighted with water or sand or other convenient substance, the housing would perform its intended function. The empty garbage can 12 that had been inserted into the housing would not be blown away by a strong gust of wind.

The garbage can unit with a weighted base according to the present disclosure was proposed to fulfill the need for an improved and convenient means for securing garbage cans and prevent it from being blown away by a strong gust of wind. The appealing features of the unit would be its mobility, ease of use, convenience, durability, reduction of messes, timesaving qualities, and cost effectiveness. Garbage collectors would insert an empty can into the housing. Homeowners would not have to retrieve empty trash receptacles that had been blown into the street. In addition, drivers would no longer have to be concerned about avoiding empty trashcans that had been blown into the street. Homeowners would not have to incur the cost of replacing cans that had been lost. The unit could be utilized by commercial businesses and in public parks as well.

Those skilled in the art can now appreciate from the foregoing description that the broad teachings of the present disclosure can be implemented in a variety of forms. Therefore, while this housing and the whole have been described in connection with particular examples thereof, the true scope of the disclosure should not be so limited since other modifications will become apparent to the skilled practitioner upon a study of the drawings, specification and claims that follow.

What is claimed is:

1. A garbage can housing with weighted base comprising a body, a wheel assembly and a T-shaped handle, the housing having a substantially parallelepipedal shape with a bulged bottom portion, a cylindrical recess being made in the housing to receive the can, the bulged bottom portion of the housing being made hollow, separated fluid wise from the recess, and provided with a closeable inlet to thereby allow filling an inner space of the bulged bottom portion with a filler, and the wheel assembly and the T-shaped handle being attached to the housing.

2. The garbage can housing with weighted base as claimed in claim 1, wherein the closeable inlet is provided with a plug and located at a front side of the bulged bottom portion of the housing.

3. The garbage can housing with weighted base as claimed in claim 1, wherein the wheel assembly includes a pair of wheels on a common axle attached by means of two axle holders to a rear side of the bulged bottom portion of the housing.

4. A garbage can unit with weighted base comprising
a garbage can,
a housing,
a wheel assembly, and
a T-shaped handle,
the garbage can having a substantially cylindrical body provided with a flange at an upper peripheral edge of the body with a pair of handles integrally formed on diametrically opposite sides of the body,
the housing having a substantially parallelepipedal shape with a bulged bottom portion, a cylindrical recess being made in the housing to receive the can,
the bulged bottom portion of the housing being made hollow, separated fluid wise from the recess, and provided with a closeable inlet to thereby allow filling an inner space of the bulged bottom portion with a filler,
the wheel assembly and the T-shaped handle being attached to the housing.

5. The garbage can unit with weighted base as claimed in claim 4, wherein said pair of handles is integrally formed on diametrically opposite sides of the flange of the body.

6. The garbage can unit with weighted base as claimed in claim 4, wherein the closeable inlet is provided with a plug and located at a front side of the bulged bottom portion of the housing.

7. The garbage can unit with weighted base as claimed in claim 4, wherein the wheel assembly includes a pair of wheels on a common axle attached by means of two axle holders to a rear side of the bulged bottom portion of the housing.

8. A garbage can unit with weighted base comprising
a garbage can,
a housing,
a wheel assembly, and
a T-shaped handle,
the garbage can having a substantially cylindrical body provided with a flange at an upper peripheral edge of the body with a pair of handles integrally formed on diametrically opposite sides of the body,
the housing having a substantially parallelepipedal shape with a bulged bottom portion, a cylindrical recess being made in the housing to receive the can,
the bulged bottom portion of the housing being made hollow, with no fluid communication with the recess, and being provided with a closeable inlet having a plug and located at a front side of the bulged bottom portion of the housing, to thereby allow filling an inner space of the bulged bottom portion with a filler,
the wheel assembly including a pair of wheels on a common axle attached by means of two axle holders to a rear side of the bulged bottom portion of the housing,
the T-shaped handle being attached to the housing.

9. The garbage can unit with weighted base as claimed in claim 8, wherein said pair of handles is integrally formed on diametrically opposite sides of the flange of the body.

* * * * *